US005839852A

United States Patent [19]

Mattson

[11] Patent Number: 5,839,852

[45] Date of Patent: Nov. 24, 1998

[54] ROAD SPILLWAY

[76] Inventor: Jack Mattson, Site H, Comp. 2, R.R. #1 Hazelton, B.C, Canada, V0J 1Y0

[21] Appl. No.: 654,221

[22] Filed: May 28, 1996

[30] Foreign Application Priority Data

May 31, 1995 [CA] Canada ..... 2150623

[51] Int. Cl.[6] ..... E02B 13/00; E01D 15/12; E01C 9/08

[52] U.S. Cl. ..... 105/36; 405/52; 404/2; 404/73; 14/2.4

[58] Field of Search ..... 405/36, 52, 39, 405/46, 74, 303; 14/2.4, 77.1, 78, 73; 404/2, 73

[56] References Cited

U.S. PATENT DOCUMENTS

| | | | |
|---|---|---|---|
| 38,568 | 5/1863 | D'Epineuil et al. | 404/2 |
| 1,362,952 | 12/1920 | McQueary | 404/2 |
| 3,212,267 | 10/1965 | Biehn | 404/2 |
| 4,387,882 | 6/1983 | Mansour et al. | 256/17 |
| 4,457,646 | 7/1984 | Laesch | 405/52 |
| 5,447,387 | 9/1995 | Fagan | 14/73 |
| 5,467,493 | 11/1995 | Alten | 14/69.5 |

*Primary Examiner*—Tamara L. Graysay
*Assistant Examiner*—Gary S. Hartmann
*Attorney, Agent, or Firm*—Oyen Wiggs; Green & Mutala

[57] ABSTRACT

The invention provides a road spillway comprising a porous removable deck over a ditch across a road. The road has a surface for driving on. Solid supports are provided on opposite sides of the ditch and below the surface of the road. Span members span the ditch generally below the surface of the road, removably resting on the solid supports. Deck members are positioned above, and attached to, the span members. A rigid grader bar may be attached to the top of the deck members, spanning the porous deck. The span members and deck members form a porous deck resting on the supports and spanning the ditch. The deck has a top for driving on which is generally at the level of the surface of the road. A settling pond may be provided in fluid communication with the ditch.

26 Claims, 3 Drawing Sheets

ROAD SPILLWAY

FIELD OF THE INVENTION

The invention is in the field of road drainage structures. In particular, the invention relates to a drainage ditch with a removable deck.

BACKGROUND OF THE INVENTION

Gravel roads, such as those used for logging, often become rutted through frequent use and infrequent maintenance. When it rains, water may collect in the ruts on the road surface. If the road is on a hill, water may run down the hill along the ruts in the road. Typically, runoff flowing down a rutted road will collect a significant volume of sediment derived from the loose material from which the road bed is made.

Recently, it has been recognized that runoff carrying sediment from rutted roads can cause environmental damage. If the road crosses a waterway such as a stream or river, runoff bearing sediment may be drained from the road into the waterway. When sediment from road runoff enters a waterway, it may adversely impact the biology of the waterway. This problem may be compounded where a number of roads cross a particular waterway. In some cases, environmental damage of this kind can threaten the viability of the commercial operations that require the roadways. There is therefore a need for structures that prevent road runoff bearing sediment from reaching waterways.

Many of the roads on which there is a problem with runoff bearing sediment are located in remote areas. Logging roads, for example, commonly traverse small streams and larger rivers in remote, hilly areas that receive significant amounts of rainfall. It would be desirable if the structures for preventing road runoff from reaching waterways were easily assembled in the remote regions in which they are required.

In many cases, remote roads are temporary in nature. These roads must often be closed to traffic once commercial operations that make use of the roads are completed. Closure of the roads may be desired, for example, to prevent public access to private or aboriginal lands. However, it is often desirable at some point to reopen remote roads that have been closed to public access. For example, logging operations may resume on new forest growth many years after an area has first been logged. It would therefore be desirable if structures for preventing road runoff from reaching waterways could also be adapted to facilitate closure of roads once commercial operations are concluded, and also to facilitate subsequent reopening of the roads to permit resumption of commercial activities.

SUMMARY OF THE INVENTION

The invention provides a road spillway comprising a porous removable deck over a ditch across a road. Runoff water flowing down ruts in the road falls through the deck and into the ditch, rather than flowing further down the road to drain into a natural waterway. From the ditch, the runoff may be directed to a settling pond in which the silt may precipitate before the runoff is eventually released. In this way, the invention may be used to alleviate fouling of waterways by silty runoff from roads. The removable deck of the spillway is adapted to be held securely in position over the ditch, as described in further detail below, but also to be easily removable to allow closure of the road.

In accordance with the invention, solid supports are provided on opposite sides of a ditch across a road and generally below the surface of the road. A settling pond may be provided in fluid communication with the ditch. A porous deck is formed over the supports spanning the ditch. In one embodiment, the porous deck comprises span members and deck members. The span members are spaced apart and span the ditch, generally below the surface of the road, removably resting on the solid supports. The deck members are spaced apart and are positioned above, and attached to, the span members. The deck members may be arranged perpendicularly to the span members.

The porous deck has a top for driving on which is generally at the level of the surface of the road. In one embodiment, the deck members forming part of the top of the porous deck are generally perpendicular to the road. In this embodiment, there are gaps between the deck members and the gaps are perpendicular to the road. These gaps could allow a grader blade to catch on the deck members. To address this potential problem, a rigid grader bar may be attached to the top of the deck members, spanning the deck members of the porous deck. When ploughing across the porous deck, a grader blade may then ride across the deck on the grader bar.

The span members may be open ended tubes, such as square steel tubes, having interior bores. The road may have a bed made up of loose material such as gravel and the bores of the span members may contain portions of the loose material. Retaining members, such as planks, may be attached to the deck between adjacent span members to prevent the loose material from falling into the ditch. The ends of the span members may be bevelled outwardly from the top sides of the span members to the bottom sides of the span members, so that the bottom sides are longer than the top sides. Bevelling the ends of the span members facilitates entry of the loose material from the road bed into the span members.

The spillway may be made up of two solid supports, each lying across the road on opposite sides of the ditch, with their long axes at an angle to the road. The angle may be offset from 90°, so that the ditch is not perpendicular to the road. The solid supports may be made out of reinforced concrete and may be L-shaped in cross-section (the cross-section being perpendicular to the long axis of the supports). In this embodiment, the lower horizontal portions of the supports form footings extending away from the ditch, into the bed of the road below the surface of the road. The vertical portions of the supports form the sides of the ditch.

Abutments may be attached to the span members and positioned to abut against the solid supports. The abutments may be made out of angle iron. The abutments hold the span members in place relative to the solid supports and help to prevent the solid supports from moving towards each other and encroaching on the ditch.

The road spillway may advantageously be positioned adjacent to a portion of the road that crosses a waterway. The spillway may also be adjacent to a portion of the road that climbs a hill. Preferably, the spillway is between the hill and the waterway. When positioned in this way, the spillway collects runoff from the portion of the road that is on the hill before the runoff gets to the waterway.

The invention provides a method of forming a spillway on a road, comprising the steps of:

a) forming a transverse ditch in the road;

b) forming a settling pond in fluid communication with the ditch;

c) placing solid supports on opposite sides of the ditch generally below the surface of the road; and, d) placing a porous deck on the solid supports spanning the ditch, the deck having a top for driving on generally at the level of the surface of the road.

The porous deck that is installed according to the method of the invention to form a spillway, may be constructed according to the preceding description of the porous deck of the invention.

The invention provides a removable spillway deck for spanning a ditch formed in a road, the ditch being defined by a pair of solid supports on either side of the ditch and the road having a surface for driving on. The removable spillway deck is positionable on the solid supports and comprises:

a) span members adapted to span the ditch and removably rest on the solid supports, generally below the surface of the road, the span members comprising open ended tubes having interior bores;

b) deck members above and attached to the span members;

c) retaining members attached to the spillway deck between adjacent span members to block off the gaps between the span members; and, d) abutments attached to the transverse members, the abutments being placable to abut the solid supports to hold the span members in place relative to the solid supports and to prevent the solid supports from moving towards each other and encroaching on the ditch.

The invention provides a kit for building a spillway on a road, the road having a surface for driving on, the kit comprising:

a) solid supports adapted lie across the road on opposite sides of a ditch across the road; and, b) a removable spillway deck comprising:

i) span members adapted to span the ditch and removably rest on the solid supports generally below the surface of the road, the span members comprising open ended tubes having interior bores;

ii) deck members above and attached to the span members;

iii) retaining members attached to the spillway deck between adjacent span members to block off the gaps between the span members; and, iv) abutments attached to the transverse members, the abutments being placable to abut the solid supports to hold the span members in place relative to the solid supports and to prevent the solid supports from moving towards each other and encroaching on the ditch.

DETAILED DESCRIPTION OF THE PREFERRED EMBODIMENT

Figure 1:
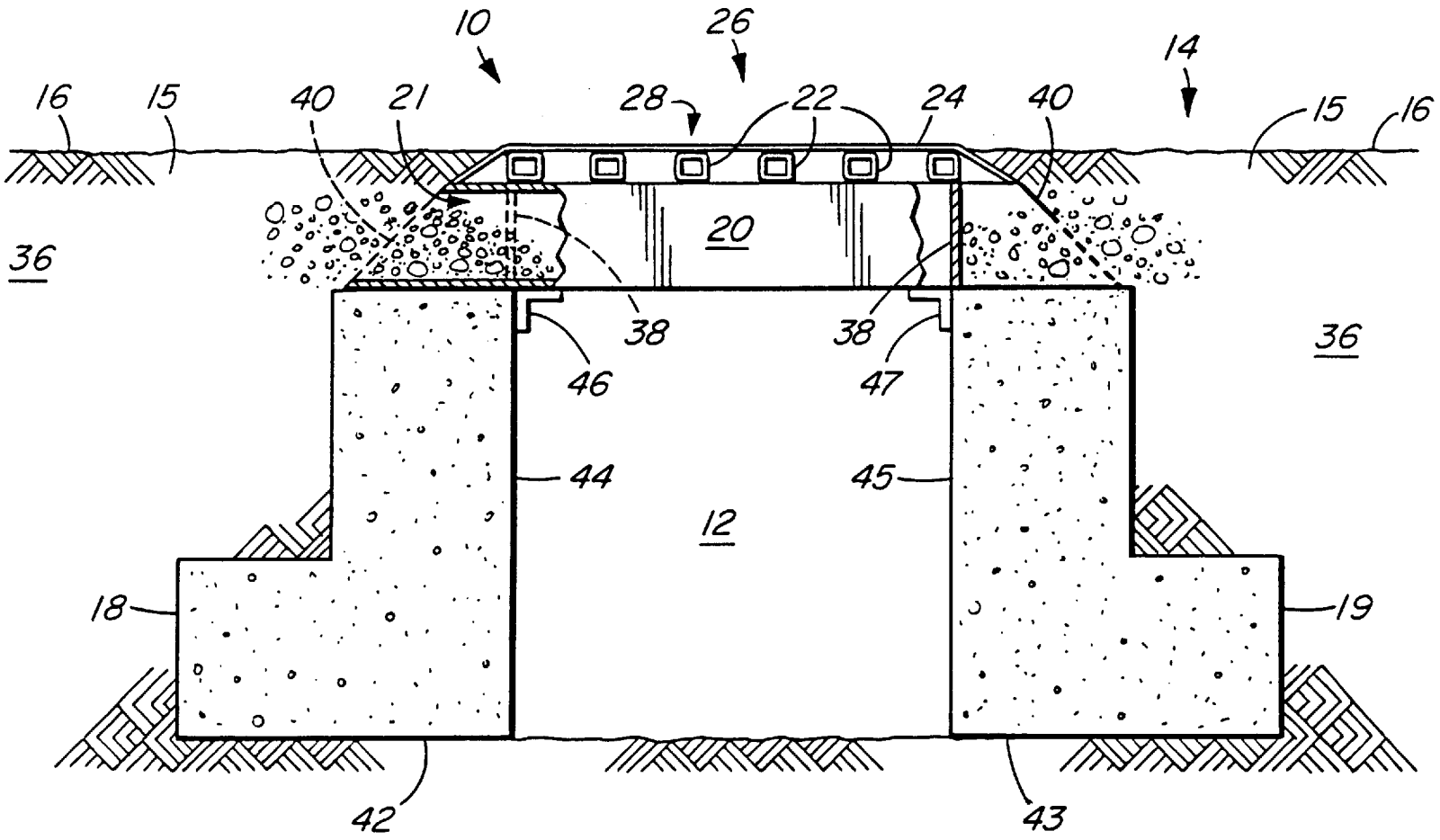
FIG. 1 is a side elevational view of the spillway in partial cross-section showing the L-shaped supports on either side of the ditch.
Figure 3:
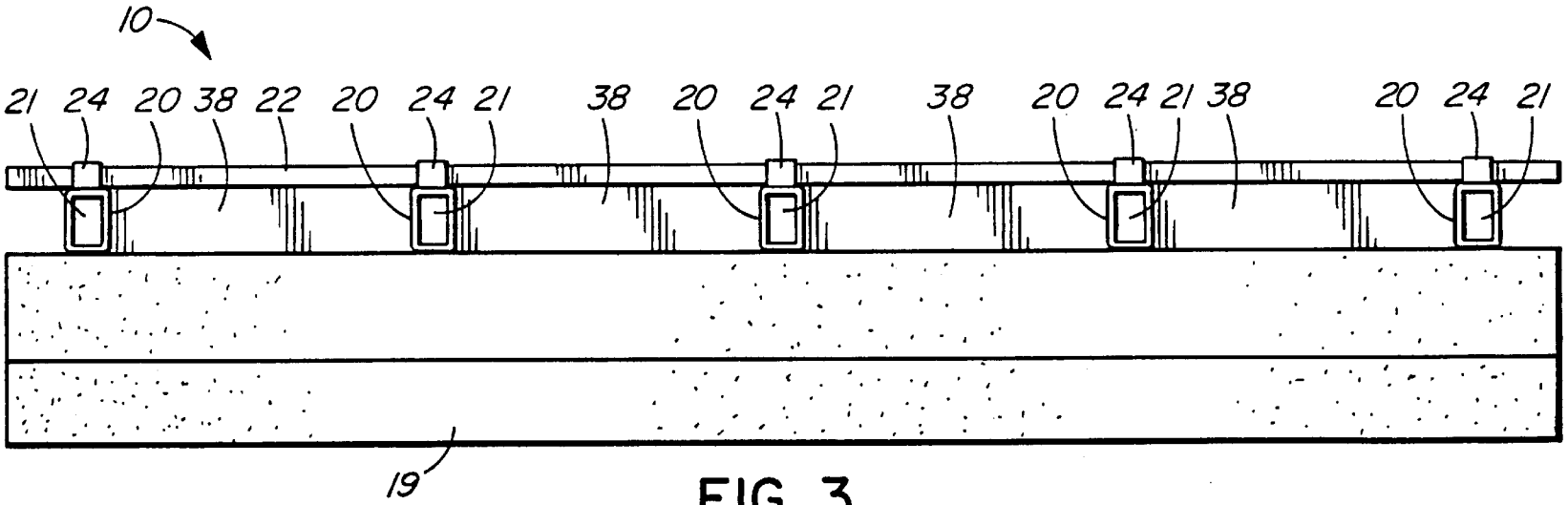
FIG. 3 is a front elevational view of the spillway showing the uncovered L-shaped supports.

As illustrated in detail in FIGS. 1 and 3, spillway 10 comprises ditch 12 across road 14. As discussed in more detail below, ditch 12 is typically formed as part of the process of installing spillway 10. Road 14 has a surface 16 for driving on. Solid supports 18, 19 are provided on opposite sides of ditch 12 and below surface 16 of road 14. Spaced apart span members 20 span ditch 12 generally below surface 16 of road 14. Span members 20 removably rest on solid supports 18, 19. Span members 20 may be open ended 6"×8"×¼" square steel tubes having interior bores 21. Spaced apart deck members 22 may be positioned above span members 20. Deck members 22 may be 3"×4"×¼" steel tubing approximately 24' long and may be welded to span members 20. Span members 20 and deck members 22 form a porous deck 26 removably resting on solid supports 18, 19 and spanning ditch 12. Deck 26 has a top 28 for driving on which is generally installed at the level of surface 16 of road 14, so that water flows from road surface 16 onto deck top 28 and then into ditch 12. A rigid grader bar 24 of ½"×4" flat bar may be attached, for example by welding, to the top of deck members 22 to facilitate ploughing over top 28 of spillway 10.

Road 14 may have a bed 15 made up of loose material 36 such as gravel. Bores 21 of span members 20 may contain portions of loose material 36, as is discussed in more detail below in connection with the description of the method of installing spillway 10. Loose material 36 in bores 21 helps to weigh down deck 26 to hold it in place on solid supports 18, 19 and dampen vibration caused by vehicles passing over top 28 of deck 26. Plank retaining members 38 may be attached to deck 26 between adjacent span members 20 to prevent loose material 36 from falling into ditch 12. Ends 40 of span members 20 are bevelled outwardly from the top sides of span members 20 to the bottom sides of span members 20, so that the bottom sides are longer than the top sides. Bevelling ends 40 of span members 20 facilitates entry of loose material 36 from road bed 15 into span members 20, as discussed below in connection with the installation of spillway 10.

Solid supports 18, 19 lie transversely across road 14 on opposite sides of ditch 12, with their long axes at an angle slightly offset from 90° to road 14, so that ditch 12 is not perpendicular to road 14. This offset of the angle of spillway 10 to road 14 reduces the vibration that vehicles experience in crossing the over deck top 28, since the vehicle wheels on one axle will not simultaneously fall into the spaces between deck members 22.

Solid supports 18, 19 may be made out of pre-cast, reinforced concrete and may be L-shaped in transverse cross-section (the cross-section being perpendicular to the long axis of solid supports 18, 19). Lower horizontal portions 42, 43 of solid supports 18, 19 form footings extending away from ditch 12, into bed 15 of road 14, below surface 16 of road 14. Vertical portions 44, 45 of supports 18, 19 form the sides of ditch 12 and may be approximately 2' high. Solid supports 18, 19 may be approximately 20' long, in which case they may be used to traverse a single lane road and are portable within the box of a standard dump truck, together with a 24' long embodiment of deck 26.

Abutments 46, 47 may be attached to span members 20 and positioned to abut against solid supports 18, 19. Abutments 46, 47 may be made out of 3"×3"×¼" angle iron and may be welded to span members 20. Abutments 46, 47 hold span members 20 in place relative to solid supports 18, 19 and prevent the top portions of solid supports 18, 19 from moving towards each other and encroaching on ditch 12.

Figure 2:
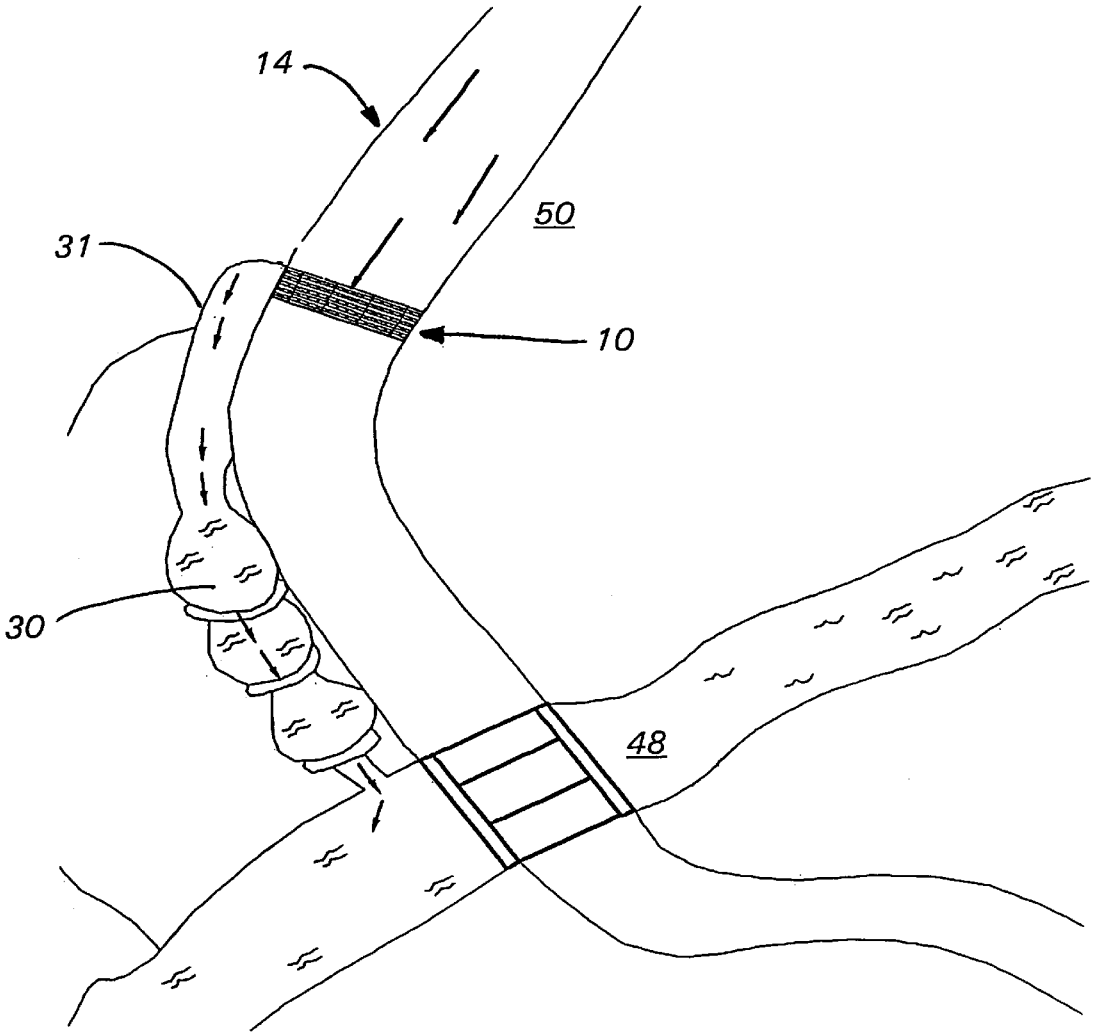
FIG. 2 is a schematic plan view of the spillway in place on a road.
Figure 4:
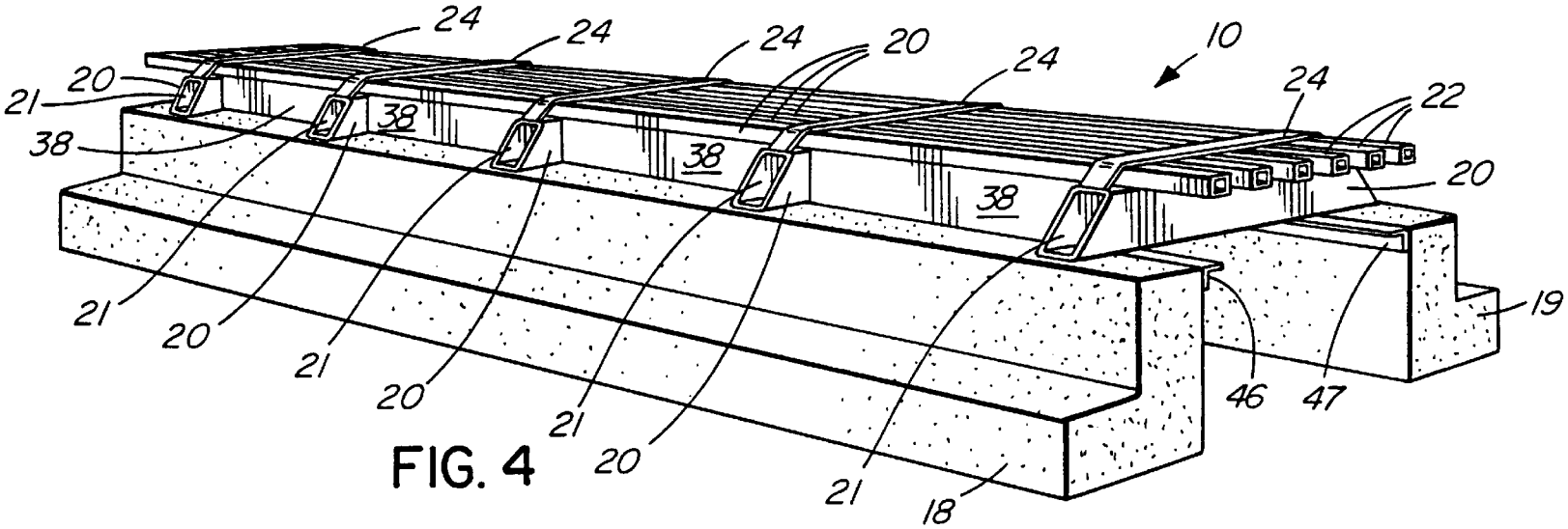
FIG. 4 is an isometric view of the spillway of FIGS. 1–3.

As shown in FIG. 2, road spillway 10 may advantageously be positioned between a portion of road 14 that crosses waterway 48 and a portion of road 14 that climbs hill 50. Settling pond 30 is connected to ditch 12 by trench 31.

Silty runoff may flow down hill 50 in rutted channels in road 14. When the runoff reaches porous deck 26, it flows into ditch 12. From ditch 12, the runoff flows through trench 31 to settling pond 30. In settling pond 30, silt precipitates from the runoff, so that clarified water may eventually flow out of settling pond 30 to river 48. In this way, the invention prevents fouling of river 48 with silt from road 14.

To install spillway 10, ditch 12 is dug across road 14. Settling pond 30 is also excavated and connected to ditch 12 by trench 31. Solid supports 18, 19 are lowered into position on either side of ditch 12. Pre-assembled deck 26 is lowered down into position on solid supports 18, 19, so that abutments 46, 47 are adjacent to the tops of solid supports 18, 19. Road bed 15 is filled in over the lower horizontal portions 42, 43 of solid supports 18, 19 so that road surface 16 is level with top 28 of deck 26. As road bed 15 is backfilled against deck 26, loose material 36 in road bed 15 may enter bores 21 in span members 20. Bevelled ends 40 of span members 20 are adapted to accept backfilled loose material 36. Backfilled loose material 36 is prevented from falling into ditch 12 by plank retaining members 38. As road 14 is used with spillway 10 in place, loose material 36 may continue to migrate into bores 21 in span members 20 to further stabilize deck 26 on solid supports 18, 19.

Deck 26 may be removed from solid supports 18, 19 to remove silt from ditch 12 or to close road 14. Even when deck 26 is removed, the remaining components of solid supports 18, 19 and ditch 12 act to redirect silty runoff to through trench 31 to settling pond 30 and thereby prevents fouling of river 48. To reopen road 14, deck 26 may be repositioned on solid supports 18, 19.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

I claim:

1. A road spillway for preventing roadway runoff from contaminating a waterway comprising:

a) a ditch formed across a road at a location between a downslope of the road and the waterway, the road having a surface for driving on;

b) solid supports removably positionable on opposite sides of the ditch and generally below the surface of the road;

c) a porous deck resting on the solid supports and spanning the ditch, the deck having a top for driving on generally at the level of the surface of the road, the deck comprising:

(i) a plurality of span members spanning the ditch, wherein the span members removably rest on the solid supports and extend generally below the surface of the road; and (ii) a plurality of spaced-apart deck members positioned above and attached to the span members; and, d) a settling pond in fluid communication with the ditch.

2. The road spillway of claim 1, wherein there are two solid supports and the solid supports:

a) lie across the road on opposite sides of the ditch; and b) are L-shaped in transverse cross-section, having vertical portions and horizontal portions when viewed in the cross-section, the horizontal portions forming footings extending away from the ditch into the bed of the road below the surface of the road, the vertical portions forming the sides of the ditch.

3. The road spillway of claim 1, further comprising abutments attached to the span members, the abutments abutting the solid supports to hold the span members in place relative to the solid supports and to prevent the solid supports from moving toward each other and encroaching on the ditch.

4. The road spillway of claim 1, wherein the span members comprise open ended tubes having interior bores, the road comprises a bed, the bed comprises a loose material and the bores of the span members contain portions of the loose material.

5. The road spillway of claim 4, further comprising retaining members that are attached to the deck between adjacent span members to prevent the loose material from falling into the ditch.

6. The road spillway of claim 4, wherein the span members have top sides and bottom sides and ends, the ends of the span members being bevelled outwardly from the top sides to the bottom sides, so that the bottom sides of the span members are longer than the top sides of the span members, thereby facilitating entry of the loose material into the span members.

7. The road spillway of claim 6, wherein there are two solid supports and the solid supports:

a) lie across the road on opposite sides of the ditch; and b) are L-shaped in a cross-section perpendicular to the long axis, having vertical portions and horizontal portions when viewed in the cross-section, the horizontal portions forming footings extending away from the ditch into the bed of the road below the surface of the road, the vertical portions forming the sides of the ditch.

8. The road spillway of claim 7, further comprising abutments attached to the span members, the abutments abutting the solid supports to hold the span members in place relative to the solid supports and to prevent the solid supports from moving toward each other and encroaching on the ditch.

9. The road spillway of claim 8, further comprising a rigid grader bar attached to the top of the deck members, the grader bar spanning the porous deck.

10. The road spillway of claim 9, wherein:

a) the loose material comprises gravel;

b) the span members comprise square steel tubing;

c) the retaining members comprise planks;

d) the abutments comprise angle irons; and e) the supports comprise pre-cast, reinforced concrete.

11. A method of forming a spillway on a road for preventing roadway runoff from contaminating a waterway, the road having a surface for driving on, comprising the steps of:

a) forming a transverse ditch in the road at a location between a downslope of the road and the waterway;

b) forming a settling pond in fluid communication with the ditch;

c) placing removable solid supports on opposite sides of the ditch generally below the surface of the road; and, d) placing a removable porous deck on the solid supports spanning the ditch, the deck having a top for driving on generally at the level of the surface of the road.

12. The method of claim 11, wherein there are two solid supports and the solid supports are placed across the road on opposite sides of the ditch; and, the solid supports are L-shaped in transverse cross-section, having vertical portions and horizontal portions when viewed in the cross-section, the horizontal portions forming footings extending away from the ditch into the bed of the road below the surface of the road, the vertical portions forming the sides of the ditch.

13. The method of claim 11, wherein the porous deck comprises:

a) span members adapted to span the ditch and removably rest on the solid supports generally below the surface of the road; and, b) deck members above and attached to the span members.

14. The method of claim 13, wherein the span members comprise open ended tubes having interior bores, the road comprises a bed, the bed comprises a loose material and further comprising the step of placing portions of the loose material in the bores of the span members.

15. The method of claim 14, wherein the porous deck further comprises retaining members attached to the deck between adjacent span members to prevent the loose material from falling into the ditch.

16. The method of claim 14, wherein the span members have top sides and bottom sides and ends, the ends of the span members being bevelled outwardly from the top sides to the bottom sides, so that the bottom sides of the span members are longer than the top sides of the span members, thereby facilitating entry of the loose material into the span members.

17. The method of claim 16, wherein there are two solid supports and the solid supports are placed across the road on opposite sides of the ditch; and, the solid supports are L-shaped in a cross-section perpendicular to the long axis, having vertical portions and horizontal portions when viewed in the cross-section, the horizontal portions forming footings extending away from the ditch into the bed of the road below the surface of the road, the vertical portions forming the sides of the ditch.

18. The method of claim 17, wherein the porous deck further comprises abutments attached to the span members, the porous deck being placed on the solid supports so that the abutments abut the solid supports to hold the span members in place relative to the solid supports and to prevent the solid supports from moving towards each other and encroaching on the ditch.

19. The method of claim 18, wherein the porous deck further comprises a rigid grader bar attached to the top of the deck members, the grader bar spanning the porous deck.

20. The method of claim 19, wherein:

a) the loose material comprises gravel;

b) the span members comprise square steel tubing;

c) the retaining members comprise planks;

d) the abutments comprise angle irons; and e) the supports comprise pre-cast, reinforced concrete.

21. The method of claim 13, wherein the porous deck further comprises abutments attached to the span members, the porous deck being placed on the solid supports so that the abutments abut the solid supports to hold the span members in place relative to the solid supports and to prevent the solid supports from moving towards each other and encroaching on the ditch.

22. A removable spillway deck for spanning a ditch formed in a road, the ditch being located between a downslope of the road and a waterway for preventing roadway runoff from contaminating the waterway, the ditch being defined by a pair of solid supports on either side of the ditch, the road having a surface for driving on, the deck being positionable on the solid supports and comprising:

a) span members adapted to span the ditch and removably rest on the solid supports generally below the surface of the road, the span members comprising open ended tubes having interior bores;

b) deck members above and attached to the span members;

c) retaining members attached to the spillway deck between adjacent span members to block off the gaps between the span members; and, d) abutments attached to the transverse members, the abutments being placable to abut the solid supports to hold the span members in place relative to the solid supports and to prevent the solid supports from moving towards each other and encroaching on the ditch.

23. The removable spillway deck of claim 22, further comprising a rigid grader bar attached to the top of the deck members, the grader bar spanning the spillway deck across the top of the deck members.

24. A kit for building a spillway on a road, the road having a surface for driving on, the kit comprising:

a) solid supports adapted to removably lie across the road on opposite sides of a ditch across the road; and, b) a removable spillway deck comprising:

i) span members adapted to span the ditch and removably rest on the solid supports generally below the surface of the road, the span members comprising open ended tubes having interior bores;

ii) deck members above and attached to the span members;

iii) retaining members attached to the spillway deck between adjacent span members to block off the gaps between the span members; and, iv) abutments attached to the transverse members, the abutments being placeable to abut the solid supports to hold the span members in place relative to the solid supports and to prevent the solid supports from moving towards each other and encroaching on the ditch.

25. The kit of claim 24, wherein the solid supports are L-shaped in transverse cross-section, having vertical portions and horizontal portions when viewed in the cross-section, the horizontal portions being positionable to form footings extending away from the ditch into the road below the surface of the road, the vertical portions being positionable to form the sides of the ditch.

26. The kit of claim 25, wherein the solid supports and the removable spillway deck are sized to fit within the box of a standard dump truck.

* * * * *